United States Patent [19]

Johansson

[11] 3,954,378

[45] May 4, 1976

[54] DIE CASTING MACHINE WITH SEVERAL MOLDS

[75] Inventor: Roland Johansson, Bromolla, Sweden

[73] Assignee: Ifö AB, Brömolla, Sweden

[22] Filed: Dec. 17, 1974

[21] Appl. No.: 533,615

[30] Foreign Application Priority Data

Dec. 17, 1973 Sweden ..... 7316977
Dec. 17, 1973 Sweden ..... 7316978

[52] U.S. Cl. ..... 425/451; 164/326; 425/441

[51] Int. Cl.[2] ..... B28B 1/24

[58] Field of Search ..... 425/439, 441, 442, 443, 425/451; 164/327, 326, 325, 130

[56] References Cited

UNITED STATES PATENTS

| | | | |
|---|---|---|---|
| 2,762,094 | 9/1956 | Vieth | 164/325 |
| 2,893,057 | 7/1959 | Rekettye | 164/326 |
| 2,978,760 | 4/1961 | Barrallon | 164/326 |
| 3,703,921 | 11/1972 | Hunter | 164/326 |
| 3,792,149 | 2/1974 | Derror | 425/439 |

FOREIGN PATENTS OR APPLICATIONS

| | | | |
|---|---|---|---|
| 185,014 | 9/1966 | U.S.S.R. | 164/327 |
| 908,887 | 1/1945 | France | 425/439 |
| 973,875 | 10/1964 | United Kingdom | 425/439 |

*Primary Examiner*—Francis S. Husar
*Assistant Examiner*—Carl Rowold
*Attorney, Agent, or Firm*—Brumbaugh, Graves, Donohue & Raymond

[57] ABSTRACT

This invention relates to a die casting machine with a rotating frame carrying several molds. These molds are arranged to advance consecutively by stepwise rotation to a common station where removal of the castings takes place. The machine is especially suited for casting objects of ceramic and similar materials, and for this reason the molds are enclosed in separable, bi-sectional flasks designed to facilitate removal of the castings.

5 Claims, 5 Drawing Figures

DIE CASTING MACHINE WITH SEVERAL MOLDS

BACKGROUND OF THE INVENTION

A die casting machine using a single mold is uneconomical for large scale production of castings because of the duplication of the complicated equipment required to service each mold automatically. When casting large or difficult-to-handle objects, plant costs are increased still further because of the special equipment required to receive and handle the casing in conjunction with its removal from the mold.

An important aspect of any die casting machine is that the mold should be fixed in a suitable position during casting to permit complete tapping and removal of all casting material sludge from the cavities of the mold. In addition, flat portions of the casting should be canted from the horizontal while tapping is performed in order to facilitate drainage. For these reasons, it is therefore often necessary during casting to tilt the mold at an angle to the vertical. The machine should also permit casting of the object in an upside down position and subsequent removal in an upright position.

The advantage of reduced duplication cost in die casting machines and the various, desirable casting procedures mentioned above are incorporated into and successfully achieved by the present invention.

SUMMARY OF THE INVENTION

In order to cast several objects simultaneously while using the same equipment for automatic control of the casting process and for removal of the objects from the molds, the die casting machine of the present invention comprises a rotatable frame carrying a number of bi-sectional flasks which enclose the molds for the objects to be cast. The frame is rotated in stepwise fashion so that the molds, after being filled with casting material, are successively advanced through a closed path to a common station where the cast objects are then removed. A locking element is provided therewith to lock the frame in an accurately determined position each time a mold is at the station.

Each of the bi-sectional flasks is arranged so that at least one of the sections can be pivoted about a horizontal axis to permit casting of the object in an upside down position and removal of the object from an upright position. The other section of the flask can be moved away from the pivotal section of the flask to permit removal of the cast object without obstruction.

DESCRIPTION OF A PREFERRED EMBODIMENT

Figure 1:
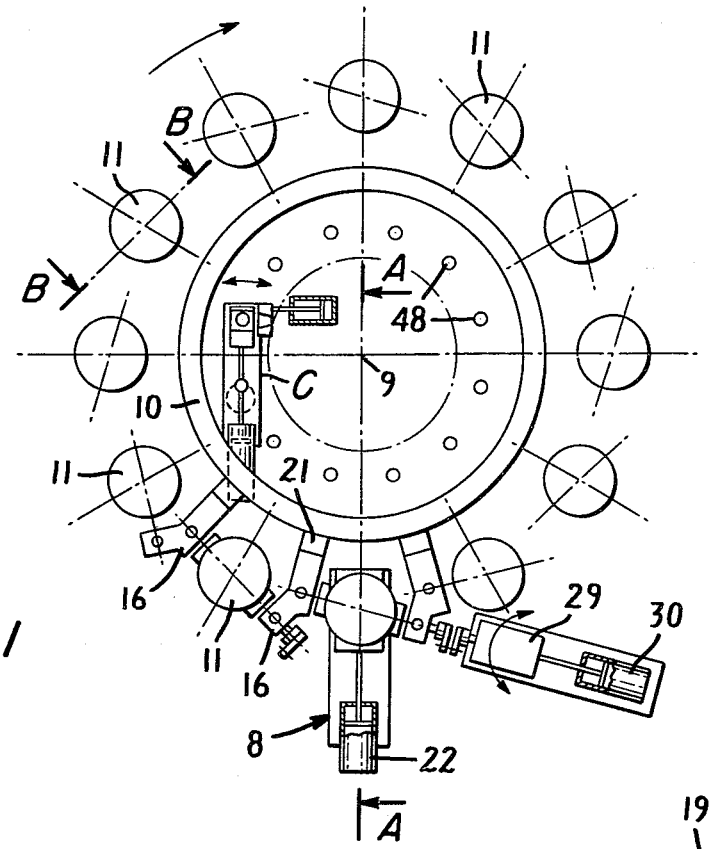
FIG. 1 is a top plan view of one embodiment of the die casting machine of the present invention.

As illustrated in FIG. 1, the disclosed die casting machine includes a carrying element represented in the form of a circular platform 10 rotatable about a vertical shaft 9. Equally spaced about the periphery of the platform 10 are a number of mold-enclosing bi-sectional flasks 11. The flasks are supported by projecting arms 16, and, as will be described herein below, the lower section of each of the flasks 11 is adapted to pivot about a horizontal axis through projecting arms 16.

When the platform 10 is intermittently rotated about shaft 9, the flasks 11 are moved sequentially to a selected station 8 where removal of the castings takes place. The castings from all the molds are removed at station 8. As the molds move circumferentially towards the removal station 8, admission of casting material and other operations of the casting process are performed. The admission of casting material and drainage of surplus material are conventional operations and hence need not be described herein nor illustrated in the drawings.

Figure 3:
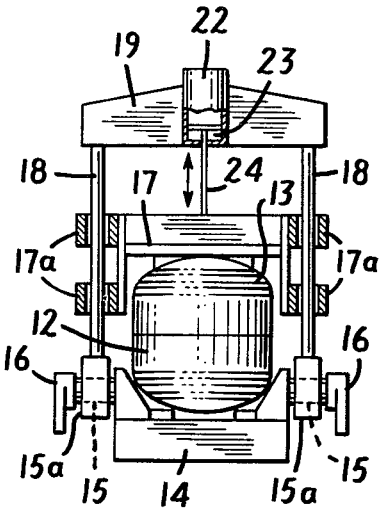
FIG. 3 is a cross-sectional front view of a flask taken along line B-B of FIG. 1.
Figure 2:
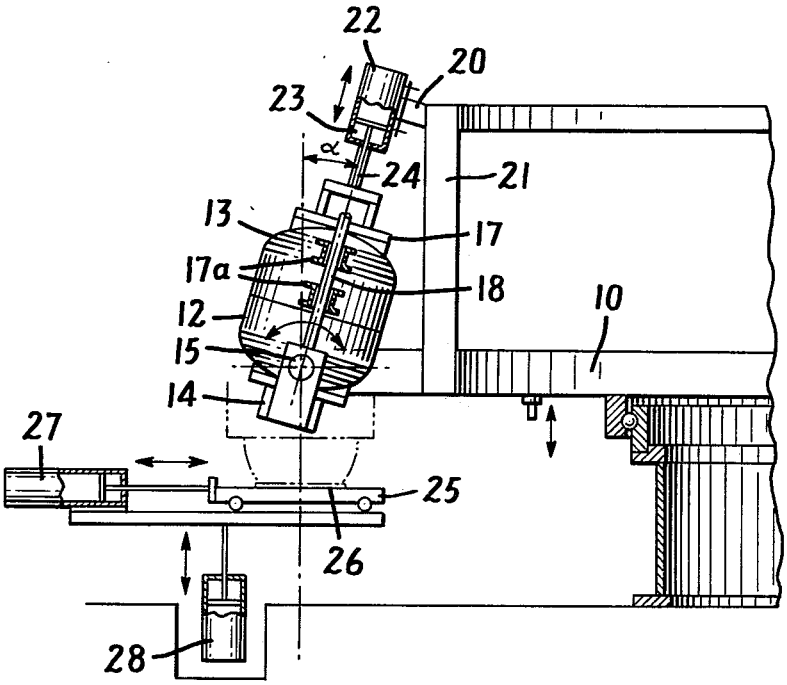
FIG. 2 is a cross-sectional side view of the machine taken along line A—A of FIG. 1.

As shown in FIG. 2, the flask 11 consists of two sections, a lower section 12 and an upper section 13. The lower section 12 is attached to a cradle 14 which pivots on two opposed horizontal studs 15 borne by the projecting arms 16, as is more clearly shown in FIG. 3. The cradle 14, and consequently the lower section 12 of the flask 11, can be swung about the pivot axis from a casting position above the studs 15 to a removal position immediately below, shown by the broken lines in the drawing.

The upper section 13 of the flask 11 is attached to a transverse beam 17 which by means of sleeves 17a is fitted so as to slide along the two parallel guides 18. Secured to the housing 15a for the studs 15 and extending up both sides of the flask 11, the parallel guides 18 permit the upper section 13 of the flask 11 to be moved linearly away from the lower section 12 holding the cast object when the flask 11 is to be opened for removal of the casting, and moved in the opposite direction back towards the lower section 12 when the flask 11 is to be closed for casting a new object.

The upper ends of the guides 18 terminate at a yoke 19 which by means of a supporting arm 20 (FIG. 2) is connected to a vertical frame member 21 on the platform 10 of the die casting machine. Carried by yoke 19, an hydraulic cylinder 22, via piston 23 and rod 24 connected to transverse beam 17, controls the upper section 13 of the flask 11 so that it can be lifted away from and brought into position on the lower section 12. Press fitting the upper section to the lower section during the casting process is also achieved by means of hydraulic cylinder 22. In order to cant the mold, guides 18 are arranged to form an angle $\alpha$ with a vertical line through the pivot axis. This angle should preferably lie within the range 0–45°.

At the removal station 8, a carriage 25 is arranged below the pivot axis for receiving the casting. This carriage 25 is moved in the horizontal plane by a hydraulic cylinder 27 and in the vertical plane by a hydraulic cylinder 28. During removal of the castings, rotation of the lower section of the flask 11 and the object in it is achieved by means of a rotational device 29, shown in FIG. 1, which is detachably coupled through the projecting arm 16 to cradle 14 and which is operated by means of a hydraulic cylinder 30.

When an object is to be cast in the mold in the flask, a suitable amount of casting material is admitted under pressure to the closed mold through lines not shown on the drawing. When the casting process is concluded and the object is to be removed from the mold, the object is first loosened from the upper mold half, which is attached to the upper section 13 of the flask 11, and then the hydraulic cylinder 22 lifts the upper section of the flask and the attached upper half of the mold away from the lower section 12 of the flask in which the casting is still held. The upper section of the flask is moved along the guides 18 away from the lower section 12 to such an extent that the lower section with the object held in it can be rotated about the pivot axis into a new position, e.g., facing straight down, in which the object can easily be removed. During this swinging movement, the casting is rotated through an angle 180° $+\alpha$. If the object has been cast in an upside down position, which, as explained earlier, is sometimes an advantage, this rotation results in turning the object right way around in conjunction with removing it from the mold. As shown in FIG. 2, the lower section 12 of the flask 11 may be swung to a position pointing straight down on removal of the object 26, as is indicated by broken lines. To receive the casting the carriage 25 is moved in underneath it.

Since the lower section 12 of the flask 11 can be pivoted, this confers the advantage that certain types of goods such as flushing cisterns can be cast upside down. This often enables surplus casting material to be more efficiently drained, particularly if it is not possible to arrange a suitable tapping hole in the bottom of the object. In addition, receiving the object right away round permits gentler and easier handling during the mold stripping process. Inclination of the mold in relation to a vertical line through the pivot axis provides scope for preventing any flat part of the object assuming a horizontal position during casting. This facilitates draining when tapping the mold and prevents the formation of globules in the upper part of the object.

Figure 4:
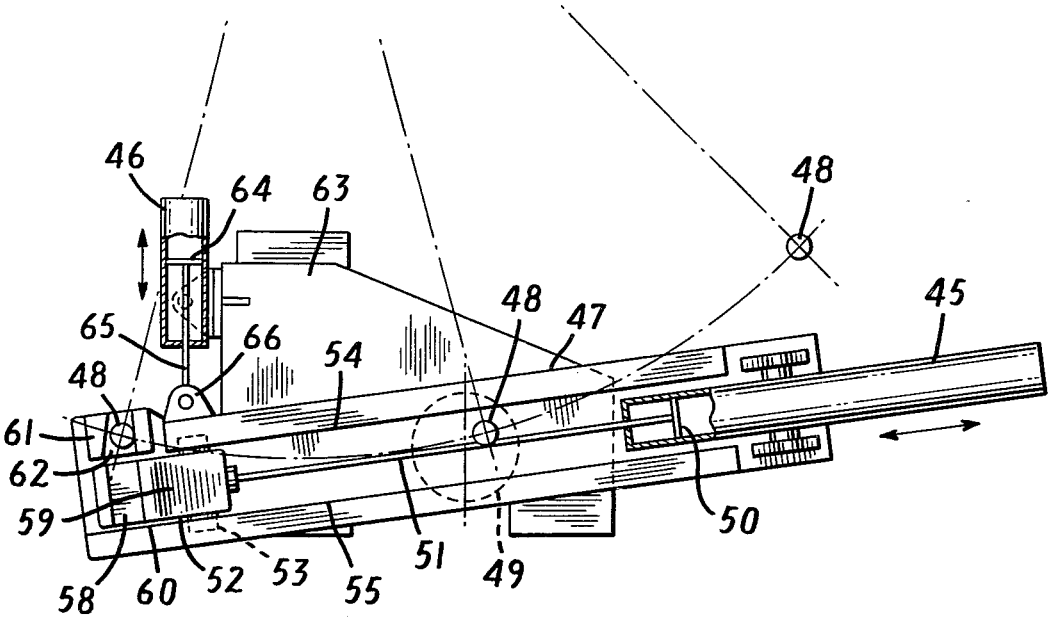
FIG. 4 is an enlarged view of the step-advance device indicated by the letter C in FIG. 1.
Figure 5:
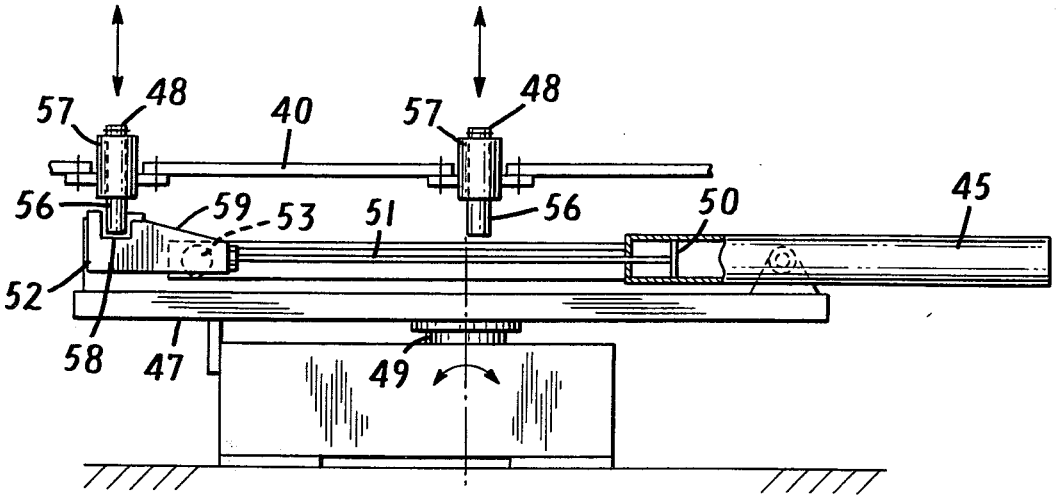
FIG. 5 is a side view of the device of FIG. 4.

Rotation of the carrying platform 10 takes place incrementally with the aid of a stepping advance device denoted by the letter C in FIG. 1 and shown in greater detail in FIGS. 4 and 5. This device incorporates hydraulic cylinders 45, 46 and a swinging arm 47 as well as a number of drivers 48 corresponding to the number of molds 11. The drivers are arranged on platform 10 in a concentric circle relative to shaft 9 and positioned so as to properly locate the molds at the removal station in conjunction with the operation of the stepping advance device.

The swinging arm 47 pivots horizontally about a vertical shaft 49. By means of the hydraulic cylinder 45 in which a reciprocating piston 50 and piston rod 51 is arranged, a gripping element 52, journalled by means of a locating stud 53 to slide along parallel guideways 54, 55 on the arm 47, can be controlled hydraulically and made to describe a linear reciprocating motion in the longitudinal direction of the swinging arm. On moving forward, the gripping element 52 should take with it a driver 48 on a platform 10. The arm is therefore so oriented that the gripping element will move approximately at right-angles to the swinging radius of the relevant driver.

The drivers 48 consist of vertically arranged studs 56 which are telescopically journalled in the sleeves 57 attached to the carrying platform 10. These sleeves are so oriented that the driver studs 56 can be displaced in a vertical direction as is shown in greater detail in FIG. 5. The driver studs 56 are normally in a lower position in which they project below the bearing sleeves 57.

The gripping element 52 is provided with a groove 58 which is positioned transversely in relation to its direction of travel and arranged to receive a driver stud 56 so that the stud can be carried along with gripping element 52 as it moves forward when piston rod 51 slides out. At its rear edge the gripping element 52 is also provided with a sloping surface 59 which wedgingly lifts up the driver stud 56 during the final portion of the return movement of the gripping element so that the lower end of the driver stud will slide up the gripping element and drop into the transverse groove 58 when the gripping element reaches its fully retracted position. Upon forward motion the driver stud being then located in the groove will consequently be carried along by the gripping element 52 to its forwardmost position. Constrained to move circumferentially, the driver stud will slide toward one end of the groove as the gripping element moves tangentially forward such that the driver stud is adjacent to the end of the groove (the upper end in FIG. 4) when the gripping element is in its forwardmost position. This end of the groove is open so that the driven stud can easily leave the groove, while the opposite end of the groove is closed by means of a wall 60.

At its front end the swinging arm 47 is provided with locking element 61 consisting of an inwardly tapering groove 62 the mouth of which is so located that it lies immediately adjacent to the open end of groove 58 in the gripping element when the gripping element is in its forwardmost position. The dimensions of the tapered groove 58 in the locking element are such that the driver stud 56 can easily enter the groove through the mouth of the groove but is then locked between the walls of the groove due to the inwardly diminishing distance between them.

Transfer of driver stud 56 from the transverse groove 58 in the gripping element to the tapered groove 62 in the locking element 61 is achieved by swinging the arm 47 about shaft 49 in such a direction that the locking element 61 is carried towards driver stud 56 until the driver stud is wedged positively between the tapering walls of the groove. The entire carrying platform with the molds arranged on it is thus locked in position so that removal of the casting from the mold which is then at the removal station can take place. The swinging arm 47 is turned by means of the other hydraulic cylinder 46 which is mounted on a frame plate 63, the reciprocating piston 64 of this hydraulic cylinder being connected by means of its piston rod 65 to a bracket 66 on the swinging arm 47.

When driver stud 56 has entered tapered groove 62 in the locking element, the gripping element 52 can perform its return movement so that the driver drops into the transverse groove in preparation for the next rotational step of the carrying platform. Before the gripping element commences its next forward movement, however, arm 47 is swung back a prescribed distance so that the previous driver stud is released from the locking element.

Through the repeated reciprocating motion of the gripping element a stepwise rotation of the carrying platform 10 and the molds arranged on it is thereby achieved. The molds 11 are spaced at equal arc intervals from each other around a circle centered with respect to the pivot axis 9 of the carrying platform. The incremental rotation of the carrying platform is determined such that a new mold is carried forward to the removal station by each rotational step, i.e., the angle of rotation is equal to the angle separating the molds.

Though only one configuration of the disclosed invention is described above, it is elementary that many different versions and modifications lie within the skilled hand's easy reach of the inventive concept. For example, the carrying element can be variously designed as a frame in which the molds are arranged in tiers.

Due appreciation should also be given to the many possible designs for the mold-carrying flasks. Further, the guides can be arranged to swing about the pivot axis of the lower section so that the angle $\alpha$ to the vertical can be set to any value desired.

In addition, the upper section of the flask can be displaced along a curvilinear, or some combination of curvilinear and rectilinear, path, it being essential only that the cast object be pivoted about a principally horizontal axis to the removal position and that the sections of the flasks be separable, in such a way that the object can be removed without further obstruction. It is possible in this connection, for example, to arrange the upper section to accompany the lower section during the pivoting movement, and then to swing to one side during removal. Furthermore, in many cases, a removal position at an inclined angle rather than pointing straight downward may be more suited toward allowing the object to slide gently out of the flask.

The invention as herein described may thus take many forms other than those which have been specifically disclosed, and it is our intention to include all equivalent die casting machines within the scope of the claims which follow.

What is claimed is:

1. A die casting machine comprising a rotatable frame, a plurality of separable, bi-sectional flasks enclosing the molds for the objects to be cast arranged on the frame at equidistant arc intervals about the periphery of the frame, at least one section of each mold-enclosing flask being pivotal from a casting position to a removal position, reciprocating means for causing relative movement between the pivotal section and the other section of each flask, means for incrementally rotating the frame over a prescribed arcuate distance corresponding to the angular separation of the flasks to advance each flask to a common station where the cast objects are then removed, and means for locking the frame in position when a flask is brought to the removal station, wherein the means for incrementally rotating the frame includes an arm swingable in the horizontal plane, and a gripping element on the arm mounted to reciprocate in a longitudinal direction of the arm and having formed thereon a rearward guide surface adjacent a groove oriented substantially transverse the direction of reciprocating movement, and wherein the frame is a horizontal platform having a plurality of drivers, corresponding in number to the number of flasks, circularly located on the frame and operatively positioned with respect to advancing a respective flask to the removal station, said drivers each consisting of a vertically displaceable stud protruding below the platform and arranged to be lifted up one at a time through engagement with the rearward guide surface of the gripping element during a reciprocating return movement thereof until the driver stud is above the groove in the gripping element, whereupon the driver stud drops into the groove and is carried along by the gripping element during a reciprocating forward movement thereof to incrementally rotate the frame.

2. A die casting machine according to claim 1 in which means for incrementally rotating the frame comprises a first hydraulic cylinder adapted to drive the gripping element in a direction at right angles to the swinging radius of the engaged driver, a second hydraulic cylinder arranged at right angles with respect to the first cylinder for controlling the motion of the swingable arm in the horizontal plane toward and away from the driver, and wherein the locking means comprises a locking element formed in the swing arm which captures the driver when the swingable arm is moved forward by said second hydraulic cylinder, following which the gripping element can perform its return movement.

3. A die casting machine according to claim 2 in which the locking element has formed therein an inwardly tapering groove, the mouth of which is located immediately adjacent to the transverse groove of the gripping element when the gripping element is in its forwardmost position, said inwardly tapering groove being arranged such that the driver is positively wedged between the tapering walls of the groove when the swingable arm is moved forward by the second hydraulic cylinder.

4. A die casting machine according to claim 1, wherein each of said flasks includes means for pivoting about a principally horizontal axis from a casting position to a removal position.

5. A die casting machine according to claim 1 having means for moving the other section into and out of a pressure fit with the pivotal section.

* * * * *